US005839622A

United States Patent [19]

Bicknell et al.

[11] Patent Number: 5,839,622

[45] Date of Patent: Nov. 24, 1998

[54] DISPENSING PACKAGE

[75] Inventors: David Huw Bicknell, Marlborough; Stephen James Carter, Wetherby; Ron Kartupelis, Aylesbury, all of United Kingdom

[73] Assignee: Chesebrough-Pond's USA Co., Division of Conopco, Inc., Greenwich, Conn.

[21] Appl. No.: 720,280

[22] Filed: Sep. 26, 1996

[30] Foreign Application Priority Data

Oct. 27, 1995 [GB] United Kingdom ..... 9521992

[51] Int. Cl.[6] ..... A45D 40/04; A45D 40/06; B67D 5/42

[52] U.S. Cl. ..... 222/390; 222/391; 401/172; 401/175; 401/179; 401/181

[58] Field of Search ..... 222/390, 391, 222/386, 108; 401/172–175, 179, 181

[56] References Cited

U.S. PATENT DOCUMENTS

| | | | |
|---|---|---|---|
| 1,663,338 | 3/1928 | Gagne | 222/390 |
| 4,595,124 | 6/1986 | Duval et al. | 222/390 X |
| 4,767,032 | 8/1988 | Smith | 222/386 X |
| 4,865,231 | 9/1989 | Wiercinski | 222/391 X |
| 5,000,356 | 3/1991 | Johnson et al. | 222/391 |
| 5,573,341 | 11/1996 | Iaia | 401/175 X |

FOREIGN PATENT DOCUMENTS

| | | | |
|---|---|---|---|
| 0 242 179 | 10/1987 | European Pat. Off. . | |
| 0 312 165 | 4/1989 | European Pat. Off. . | |
| 808754 | 2/1937 | France | 222/390 |
| 261014 | 4/1949 | Switzerland | 401/175 |
| 281384 | 3/1952 | Switzerland | 222/390 |
| 1 301 342 | 12/1972 | United Kingdom . | |
| 2146612 | 4/1985 | United Kingdom | 222/391 |

*Primary Examiner*—Kevin P. Shaver
*Attorney, Agent, or Firm*—Milton L. Honig

[57] ABSTRACT

A dispensing package for cream compositions is provided which includes a container body have a longitudinal central axis. The container body defines a storage chamber for the composition. An opening in the container body is present for discharging the composition. A fixed cam opposite the opening has teeth oriented tangentially to the longitudinal axis. A rotatable cog mounted on the cam has a plurality of ratchet teeth engageable with the teeth of the fixed cam. The cog is provided with external peripheral cams oriented parallel with the longitudinal axis. A spindle mounted on the cog extends along the central longitudinal axis between the cog and the opening. An elevator is mounted on the spindle and is displaceable between the cog and the opening to dispense the composition through the opening. A pawl is oriented transverse to the longitudinal axis and is engageable with the peripheral cams to rotate the cog and spindle on the fixed cam. An actuator button is attached to the pawl to urge the pawl against the peripheral cam. Upon actuation of the button, the cog and spindle ride on the fixed cam with a reciprocating motion which is transferred to the elevator via the spindle.

11 Claims, 2 Drawing Sheets

DISPENSING PACKAGE

BACKGROUND OF THE INVENTION

1. Field of the Invention

The invention relates to a dispensing package for cream type compositions. More particularly, the invention concerns a package for use in applying a cream-type composition to the underarm.

2. The Related Art

Dispensing packages for use in applying cream compositions particularly to the underarm are known.

Generally, a cream composition is dispensed from the packs of the prior art using an elevator to urge the composition outwards from the pack. The use of an elevator within the pack causes pressure to be exerted on the cream composition so that the product is dispensed through an orifice onto the axilla of a user. The cream can then be massaged into the skin of the user by rubbing the pack against the skin.

However, following the dispensing of the cream composition a residual pressure remains on the product. The residual pressure causes the product to seep onto the applicating surface of the pack between uses resulting in product wastage and soiling of the applicator.

Various packs of the prior art have attempted to overcome the disadvantages associated with the residual pressure by utilising various spring mechanisms which urge the elevator away from the product following use.

European Patent Specification Number 312165 attempts to overcome difficulties associated with the use of spring activated mechanisms, namely variations in the degree of retraction of the elevator by the spring due to the nature of the unpredictability of the spring and the complex mechanisms required to assemble such packs. European Patent Specification Number 312165 attempts to overcome the aforementioned problems by providing a pack in which an elevator follows a reciprocating motion to relieve pressure on the cream compositions following use.

However, it has been found that the packs of the prior art can still be subject to leakage as a result of the general nature of cream underarm compositions which contain volatile and non-volatile emollients such as silicones and the like. Such materials are found to easily seep or weep past the various mechanisms described in the containers of the prior art.

Moreover, many of the containers of the prior art can present difficulties to the user during use. For instance, containers requiring thumb wheels require two-handed operation i.e. the container is held with one hand while the thumb wheel is rotated.

In addition, the highly viscous nature of the creams can result in dispensing mechanisms which require considerable force to urge the cream from the pack - again sometimes requiring two-handed operation.

Accordingly, many of the packages of the prior art demand a two step process to apply a cream composition namely a dispensing step and an application step.

An object of the invention is to provide a dispensing package for cream underarm compositions which overcomes the problems of the prior art and in which residual pressure on the composition is relieved following use and in which seeping or weeping of material from the pack is minimised.

SUMMARY OF THE INVENTION

According to the invention there is provided a dispensing package for cream compositions comprising:

(a) a container body having a longitudinal central axis;

(b) the container body defining a storage chamber for the composition;

(c) an opening in the container body for discharging the composition;

(d) a fixed cam opposite said opening having teeth orientated tangentially to said longitudinal axis;

(e) a rotatable cog mounted on said cam having a plurality of ratchet teeth engageable with the teeth of said fixed cam;

(f) the cog being provided with external peripheral cams oriented parallel with said longitudinal axis;

(g) a spindle mounted on said cog and extending along said central longitudinal axis between the cog and the opening;

(h) an elevator mounted on said spindle and displaceable between the cog and the opening to dispense the composition through the opening;

(i) a pawl oriented transverse to the longitudinal axis and engageable with said peripheral cams to rotate the cog and spindle on the fixed cam, and (j) an actuator button attached to said pawl to urge the pawl against the peripheral cam.

such that, upon actuation of the button, the cog and spindle ride on the fixed cam with a reciprocating motion which is transferred to the elevator via the spindle.

BRIEF DESCRIPTION OF THE DRAWING

The invention will now be described having regard to the accompanying drawings in which.

DETAILED DESCRIPTION OF THE INVENTION

Figure 1:
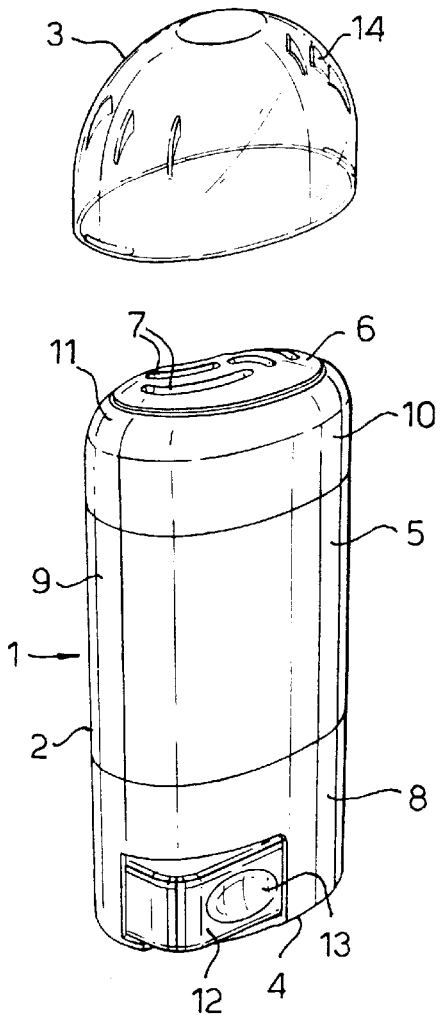
FIG. 1 is a perspective view of the dispensing package of the invention with the cap removed.

As shown in FIG. 1, a dispensing package (1) of the invention is made up of a body portion (2) having a cap (3) mounted thereon. The body portion (2) is defined by an oval shaped base wall (4) with a side wall (5) upstanding therefrom. The side wall (5) terminates in an opening (15) provided with a grill type top (6). The grill (6) defines openings (7) through which a cream can be dispensed.

The body portion (2) is made up of three units namely a base portion (8) a central storage chamber (9) and a top portion (10). The base portion (8), the central storage chamber (9) and the top portion (10) are continuous to define the side wall (5) of the body. The side wall (5) of the body curves inwards towards the opening (15) to define an overhang (11) which is in mating relationship with the grill (6).

The top portion (10) and the storage chamber (9) are also continuous with another to define the internal volume from which the composition is dispensed from the package. The overhang (11) ensures that fluid composition does not discharge from the container before mounting of the grill (6) in the opening (15). This is particularly advantageous during filling of the package with the composition when it is necessary to move the package along a production line.

The base portion (8) is provided with a push button (12) which protrudes from the base portion (8). The button (12) is provided with an indent (13) to facilitate depression of the button (12) with a finger.

The cap (3) is transparent so that the openings (7) of the grill (6) are visible. The cap (3) is dome-shaped and forms a tight fit with the top portion (10) of the body (2). The interior surface of the cap (3) is provided with stops (14) to maintain a head space between the cap (3) and the grill (6).

Figure 2:
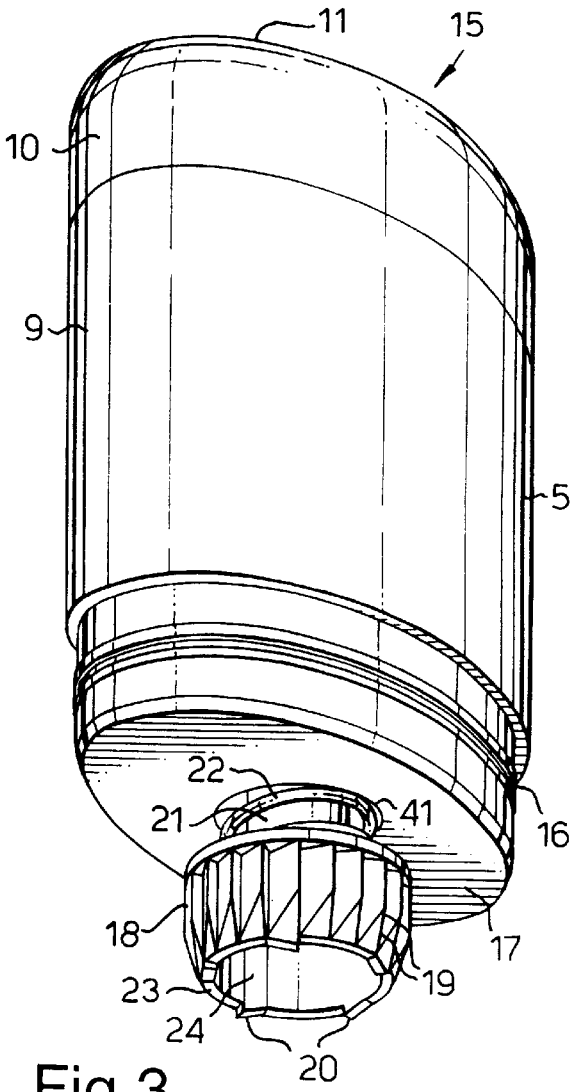
FIG. 2 a perspective view of the dispensing package of FIG. 1 with the base portion of the body removed to show the cog, spindle and spring.

FIG. 2 shows a perspective view of the central storage chamber (9) with the base portion (8) removed. As shown in the drawings, the side wall (5) of the central storage chamber (9) is provided with a series of stepped ridges (16) which form a tight friction fit with the base portion (8). The central storage chamber (9) is provided with a bottom wall (17) to separate the central storage chamber (9) and the composition contained therein from the base portion (8). The side wall (5) of the central storage chamber (9) is upstanding from the bottom wall (17). The bottom wall (17) is provided with an orifice (41). A spindle (21) is inserted through the orifice (41) and is fixedly mounted on a rotatable cog (18) such that rotation of the cog (18) causes the spindle (21) to rotate. The rotatable cog (18) is provided with a side wall (24) moulded to define a peripheral toothed cam (19) oriented along the longitudinal axis of the spindle (21).

The side wall (24) is provided with five ratchet teeth (20) oriented in a plane horizontal to the longitudinal axis of the spindle (21). The ratchet teeth (20) are disposed on the rim (23) of the side wall (24). A spring (22) is disposed between the cog (18) and the central storage chamber (9). The arrangement of the spring is more fully described with reference to FIG. 4 below.

Figure 3:
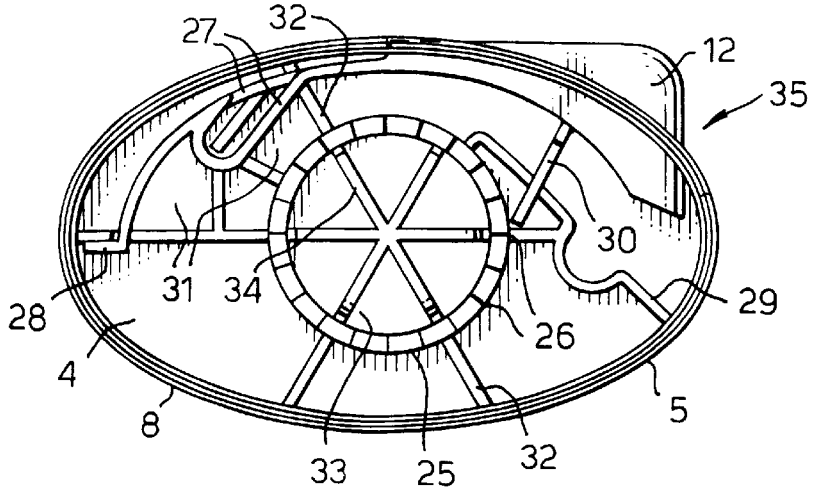
FIG. 3 is a top plan view of the base portion of the body showing the secondary and tertiary well.

FIG. 3 shows a top plan view of the base portion (8) of the body (2). As shown in the drawing, the base portion (8) is defined by the base wall (4) with the side wall (5) upstanding therefrom. Internally, the base portion (8) is provided with a centrally located circular fixed cam (25) having a diameter complimentary with the diameter of the rim (23) of the cog (18). The fixed cam (25) is mounted on the base wall (4) of the base portion (8). At its free end, the fixed cam (25) is provided with a series of teeth (26) complimentary with and engageable with the ratchet teeth (20) of the rotatable cog (18).

The button (12) is mounted in the side wall (5) of the base portion (8) and is displaceable into the base portion (8) through a button opening (35) provided in the side wall (5).

The button (12) is resilient due to a button spring (27) attached to the interior of the base portion (8) by a button spring mounting (28). The button spring (27) enables the button (12) to be depressed. The button (12) is prevented from excessively entering the base portion (8) during depression by a button stop (29) fixed to the interior surface of the side wall (5).

The button (12) is also provided with a pawl (30) oriented inwards towards the interior of the base chamber (8). The pawl (30) is engageable with the toothed cam (19) of the cog (18) as will be described more fully below.

The base chamber (8) is further provided with a secondary series of walls (32) upstanding from the base wall (4). The secondary series of walls (32) defined secondary wells (31) for holding any composition which seeps through the orifice (41) into the base chamber (8).

Furthermore, the fixed cam (25) is also provided with a tertiary series of walls arranged in spoke-like fashion upstanding from the base (4) of the base portion (8) to define a tertiary series of wells also to store any composition which seeps past the orifice (41).

Figure 4:
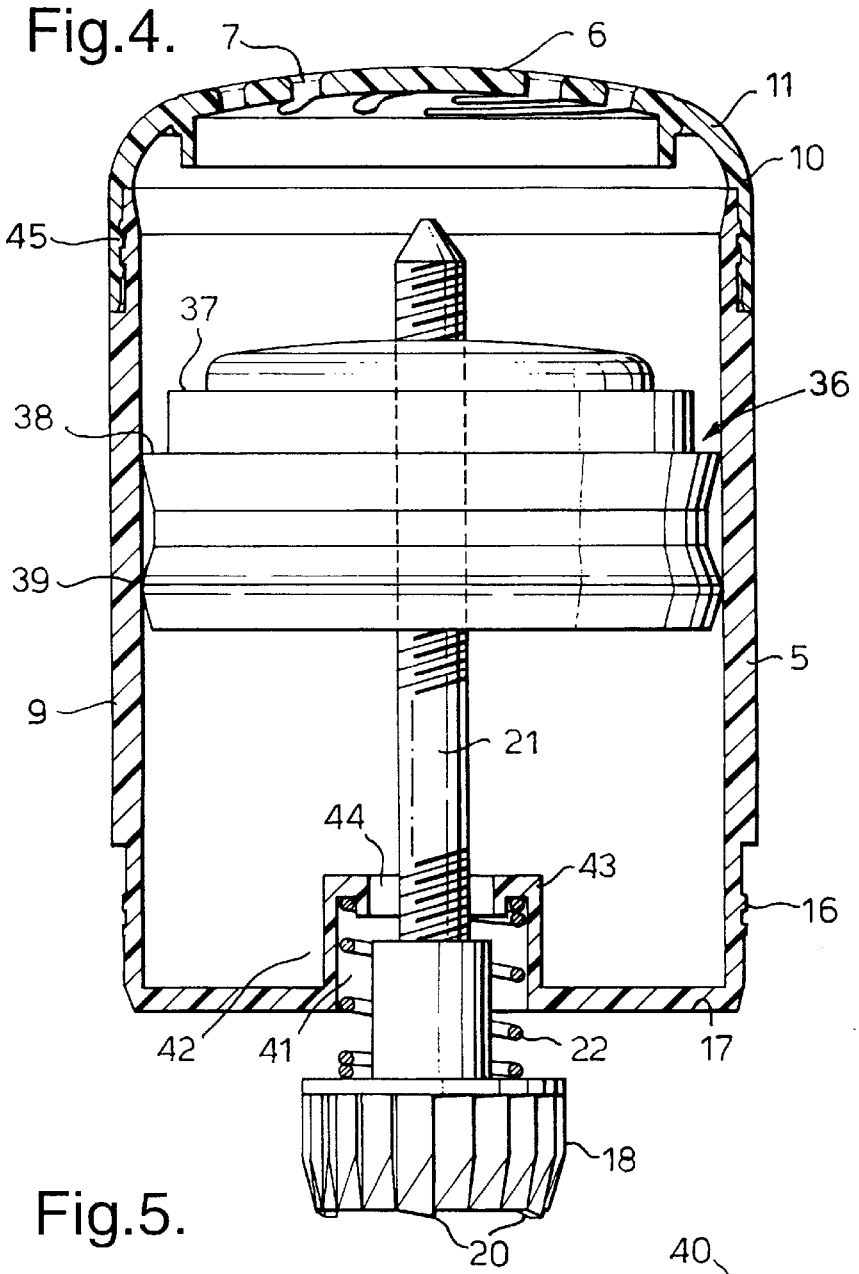
FIG. 4 is a longitudinal cross-section through the body of the dispensing package with the base portion removed to illustrate the elevator and spindle.

FIG. 4 describes a longitudinal cross-sectional view through the central storage chamber (9). The central storage chamber (9) is provided with a bottom wall (17) and a side wall (5) upstanding therefrom as previously described. The spindle (21) mounted on the cog (18) is inserted through the orifice (41) into the central storage chamber (9). The bottom wall (17) is adapted to project inwards towards the interior of the central storage chamber (9) to define a bush (43) around the spindle (21). The bush (43) defines a smaller secondary orifice (44) through which the spindle (21) projects. The spring (22) is disposed between the cog (18) and the bush (43).

The bush (43), the bottom wall (17) and the side wall (5) of the central storage chamber (9) together define a primary well (42) which also ensures minimal leakage of composition through the orifice (44).

An elevator (36) is mounted on the spindle (21) and is displaceable between the bush (43) and the openings (7).

The elevator (36) is in sliding relationship with the interior surface of the side wall (5). The elevator (36) is provided with a peripheral channel spaced from the interior surface of the side wall (5) to trap the composition to be dispensed and further prevent leakage past the elevator (36), a chamber sealing ring (38) situated below the peripheral channel (37) which forms a tight but sliding fit with the interior surface of the storage chamber (9) and a secondary sealing ring (39) also in a tight but sliding relationship with the interior surface of the side wall (5). The peripheral channel (37) and sealing rings (38) and (39) further enhance the resistance of the package of the invention to leakage of volatile and fluid materials.

Figure 5:
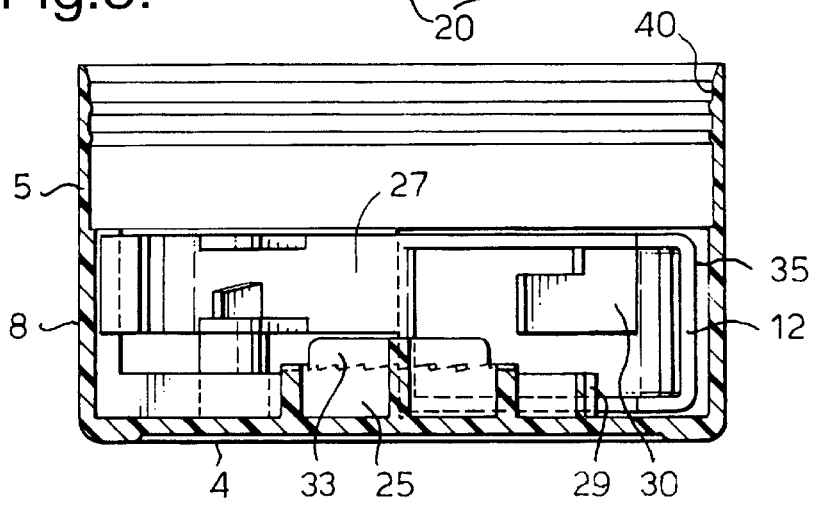
FIG. 5 is a longitudinal cross-section through the base portion showing the button and fixed cam.

FIG. 5 shows a cross-sectional view through the base chamber (8). As shown in the drawing, the interior surface of the side wall (5) of the base chamber (8) is provided with a series of complimentary ridges (40) which form a friction tight fit with the ridges (16) of the central storage chamber (9) when the package is assembled as shown in FIG. 1.

FIG. 5 more clearly illustrates the arrangement of the push button (12) and the push button spring (27). The push button (12) is displaceable in the button opening (35) in the side wall (5) of the base chamber (8) while the fixed cam (25) is upstanding from the base wall (4) of the base chamber (8). The pawl (30) projects inwards from the push button (12) towards the fixed cam (25).

The various components of the dispensing package (1) can be manufactured by utilising known moulding techniques. The package (1) is assembled by first assembling the central storage chamber (9), the spindle (21)/cog (18) and spring (22) without the top portion (10). The base portion (8) can then be engaged with the central storage chamber (9) by engaging the ridges (16) and (40) as previously described.

When the central storage chamber (9) and the base chamber (8) are assembled as described above the elevator (36) should be disposed as far as possible on the spindle (21) towards the bottom wall (17) of the central storage chamber (9).

The top portion (10) can then be fitted to the central storage chamber (9) in a frictional fit using ridges (45) on the top portion (10) and the central storage chamber (9) similar to the ridges (16, 40) previously described. The opening (15) defined by the overhang (11) then remains.

Composition to be stored within the storage chamber (9) can then be charged into the storage container (9) through the opening (15). A cream composition can be hot filled in the pack (1). Typical underarm cream compositions can have highly fluid properties when hot. Accordingly, the overhang (11) ensures that the composition is unlikely to accidentally discharge through the opening (15) during movement of the pack for instance along a production line.

Following charging of the composition into the storage chamber (9) through the opening (15), the grill (6) can then be snap fitted into the opening (15).

Composition to be dispensed from the storage chamber (9) can exit through the openings (7) of the grill (6).

The primary well (42), the secondary wells (31) and the tertiary wells (33) ensure that composition does not leak from the container over prolonged periods of time. Moreover, the tight fit formed by the various components of the pack (1) also ensure minimal leakage.

In use, to dispense composition from the storage chamber (9), the button (12) is depressed inwards. The pawl (30) therefore engages the toothed cams (19) to rotate the cog (18). The ratchet teeth (20) therefore ride over the complimentary teeth (26) of the fixed cam (25) in a reciprocating motion.

More particularly, the pawl (30) rotates the cog (18) and hence the spindle (21) to cause the elevator (36) to move upwards along the spindle (21) towards the openings (7) of the grill (6) thereby urging composition outwards through the openings (7). Simultaneously, the ratchet teeth (20) ride up the ramped teeth (26) of the fixed cam (25) until the apex or crest of the teeth (26) is reached by the ratchet teeth (20). After reaching the apex of the teeth (26) the ratchet teeth (20) are urged downwards by the bias of spring (22) so that the cog (18)/spindle (21)/elevator (36) retract to produce a suck back feature on the composition. Accordingly, no residual pressure remains on the composition following use.

The volume of composition dispensed is determined by the number of times the button (12) is depressed or "clicked" by the user. Following dispensing of the required amount of composition the spring (22) always causes the cog to retract on the fixed cam (25) to relieve pressure on the composition.

Accordingly, the interaction of ratchet teeth (20), the teeth (26) and the spring (22) provide a suck back feature which prevents seepage or leaking of the composition (7) when not in use due to pressure relief.

In order to effect dispensing of the composition, single-handed use only is required as the package (1) can be held in the hand and the button (12) depressed with the thumb. The pack is suitable for use by left-handed or right-handed people. Moreover, the composition can be massaged or rubbed into the skin surface while simultaneously clicking the button (12) to dispense composition through the openings (7).

Therefore, the package (1) facilitates rapid application of composition whilst at the same time minimising leakage of material through the pack.

Moreover, the use of a "click" mechanism with a button enables a high degree of accuracy to be used while dispensing as compared with systems that are based on rotating actuating means such as wheels.

The pack (1) can be manufactured from a variety of suitable plastics materials. For instance, the body (2) can be manufactured from polypropylene, the piston from polyethylene and the button (12) form polyoxymethacrylate which provides a roughened finish which can prevent slippage in use. The spring (22) can be of stainless steel or a plastics material. The remaining components can also be manufactured from polypropylene.

We claim:

1. A dispensing package for cream compositions comprising:

(a) a container body having a longitudinal central axis;

(b) the container body defining a storage chamber for the composition;

(c) an opening in the container body for discharging the composition;

(d) a fixed cam opposite said opening having teeth orientated tangentially to said longitudinal axis;

(e) a rotatable cog mounted on said cam having a plurality of ratchet teeth engageable with the teeth of said fixed cam;

(f) the cog being provided with external peripheral cams oriented parallel with said longitudinal axis;

(g) a spindle mounted on said cog and extending along said central longitudinal axis between the cog and the opening;

(h) an elevator mounted on said spindle and displaceable between the cog and the opening to dispense the composition through the opening;

(i) a pawl oriented transverse to the longitudinal axis and engageable with said peripheral cams to rotate the cog and spindle on the fixed cam, (j) an actuator button attached to said pawl to urge the pawl against the peripheral cam; and (k) a spring mounted between the cog and the elevator to bias the cog against the fixed cam;

wherein upon actuation of the button, the cog and spindle ride on the fixed cam with a reciprocating motion which is transferred to the elevator via the spindle.

2. A dispensing package as claimed in claim 1 characterised in that the actuator button is biased outwards from the pack by spring means extending between the button and the container body.

3. A dispensing package as claimed in claim 1 characterised in that the actuator button is off-set from the longitudinal axis of the container body to enhance leverage about the spindle.

4. A dispensing package as claimed in claim 1 characterised in that the container body has a first storage chamber having a base wall, the storage chamber housing the elevator and spindle and being mounted on and communicating with a base chamber housing the fixed cam, the rotatable cog, the pawl and the actuating button.

5. A dispensing package as claimed in claim 4 characterised in that the storage chamber communicates with the base chamber through an orifice defined by an upwardly extending skirt in the base wall of the storage chamber, the upwardly extending skirt further defining a primary well in the storage chamber.

6. A dispensing package as claimed in claim 5 characterised in that the cog is located below the base wall and the spring is mounted between the cog and the base wall such that the spring does not contact the composition.

7. A dispensing package as claimed in claim 6 characterised in that the base chamber is provided with a series of secondary wells defined by a plurality of upwardly extending walls in the base chamber to receive any composition which escapes past the primary well.

8. A dispensing package as claimed in claim 1 characterised in that the cog is wheel shaped, the fixed cam being complimentary in shape to the cog so that the teeth of the fixed cam can engage the ratchet teeth of the rotatable cog.

9. A dispensing package as claimed in claim 8 characterised in that the fixed cam is defined by an upwardly extending circular wall provided with a plurality of internal walls to define a tertiary series of internal wells for receiving the composition.

10. A dispensing package as claimed in claim 1 characterised in that the opening in the container body for discharging the composition is defined by an inwardly curved portion of the container body to define an overhang.

11. A dispensing package as claimed in claim 10 characterised in that the opening is substantially closed by a grill through which the composition is dispensed.

* * * * *